US007229342B1

(12) United States Patent
York

(10) Patent No.: US 7,229,342 B1
(45) Date of Patent: Jun. 12, 2007

(54) STONE CUTTING SYSTEM AND METHOD

(76) Inventor: Rodney L. York, 5805 Gray Leaf Cir., Knoxville, TN (US) 37918

( * ) Notice: Subject to any disclaimer, the term of this patent is extended or adjusted under 35 U.S.C. 154(b) by 0 days.

(21) Appl. No.: 11/644,425

(22) Filed: Dec. 22, 2006

(51) Int. Cl.
*B26B 1/00* (2006.01)

(52) U.S. Cl. ..... 451/178; 451/236; 83/929; 125/13.01; 125/35

(58) Field of Classification Search ..... 125/13.01, 125/14, 35; 83/929, 953, 646; 451/177, 451/178, 179, 236
See application file for complete search history.

(56) References Cited

U.S. PATENT DOCUMENTS 3,841,187 A * 10/1974 Gerber et al. ..... 83/451
3,844,269 A * 10/1974 Rater ..... 125/13.01
5,318,005 A * 6/1994 Mayer ..... 125/13.01
6,761,617 B2 * 7/2004 Tozawa ..... 451/11

* cited by examiner

*Primary Examiner*—Jacob K. Ackun, Jr.
(74) *Attorney, Agent, or Firm*—Michael E. McKee

(57) ABSTRACT

A stone cutting system and method for cutting a stone sheet having a substantially planar surface utilizes a frame upon which a stone sheet to be cut can be positioned, a motor for supporting a cutting tool adjacent the stone sheet and for rotating the cutting tool, and an articulated arm assembly enabling the cutting tool to be moved to any of a number of coordinate positions across the surface of the stone sheet. By rotating and moving the cutting tool in cutting engagement with the stone sheet, material is removed from the stone sheet by the cutting tool.

16 Claims, 3 Drawing Sheets

STONE CUTTING SYSTEM AND METHOD

BACKGROUND OF THE INVENTION

This invention relates generally to means and methods for cutting stone and relates, more particularly, to such means and methods for cutting a stone sheet, such a granite or marble sheet.

The class of stone cutting systems with which this invention is to be compared includes those which are used to shape or cut a stone sheet. A stone sheet, comprised, for example, of granite, can be cut or formed with such a cutting system for use, for example, as a kitchen countertop. Since a kitchen countertop commonly requires that an opening be cut out of the countertop material for acceptance of a sink installed therein, these cutting systems should possess the capacity to cut or form a sink-accepting cutout in a stone sheet.

Stone-cutting systems of the prior art are commonly complicated in construction, expensive to purchase and are time-consuming to use. It would therefore be desirable to provide an improved cutting system which is relatively inexpensive to construct and can be used to cut a sink-accepting opening in stone relatively quickly.

Accordingly, it is an object of the present invention to provide a new and improved stone cutting system and a method of use.

Another object of the present invention is to provide such a system which is relatively inexpensive to construct and relatively easy to use.

Still another object of the present invention is to provide such a system which employs a cutting tool which is supported for movement across the surface of a stone sheet while the tool is maintained in cutting engagement with the stone sheet.

Yet another object of the present invention is to provide such a system wherein the cutting tool of the system can be manually guided across the surface of the stone sheet.

A further object of the present invention is to provide such a system wherein the cutting tool is movable into and out of the stone sheet to accommodate an adjustment in the depth of cut in the stone sheet.

A still further object of the present invention is to provide such a system which is capable of forming a cutout in a stone sheet relatively quickly.

A yet further object of the present invention is to provide such a system which is uncomplicated in structure, yet effective in operation.

SUMMARY OF THE INVENTION

This invention resides in a system and method for cutting a stone sheet having a substantially planar surface.

The stone cutting system includes a frame upon which a stone sheet to be cut can be positioned so that a substantially planar surface of the stone sheet extends along X and Y coordinate axes. Means are also included for supporting a cutting tool for rotation about a Z-coordinate axis and for rotating the cutting tool about the Z-coordinate axis. Further still, means are joined between the frame and the tool-supporting means for supporting the tool-supporting means for movement along either of the X and Y coordinate directions to enable the cutting tool to be positioned at any of a number of X and Y coordinate locations across the substantially planar surface of the stone sheet. Means are also included for moving the cutting tool along the Z-coordinate axis toward and into engagement with the substantially planar surface of the stone sheet so that by rotating the cutting tool about the Z-coordinate axis and moving the cutting tool in cutting engagement with the stone sheet along X or Y coordinate directions, a cut is effected in the stone sheet by the cutting tool.

The method of the invention includes the steps involved to utilize the system of the present invention. Such steps include the steps of placing a stone sheet to be cut upon the frame of the system so that the substantially planar surface of the stone sheet extends along X and Y coordinate axes, and then arranging the cutting tool adjacent the substantially planar surface of the stone sheet. The cutting tool is subsequently rotated about the Z-coordinate axis and moved along the Z-coordinate direction toward and into engagement with the substantially planar surface of the stone sheet. The cutting tool is thereafter moved in cutting engagement with the stone sheet along X or Y coordinate directions to effect a cut in the stone sheet.

If desired, a template having an edge along which the cutting tool can be guided can be positioned against the substantially planar surface of the stone sheet prior to the step of moving the cutting tool in cutting engagement with the stone sheet.

DETAILED DESCRIPTION OF AN ILLUSTRATIVE EMBODIMENT

Figure 1:
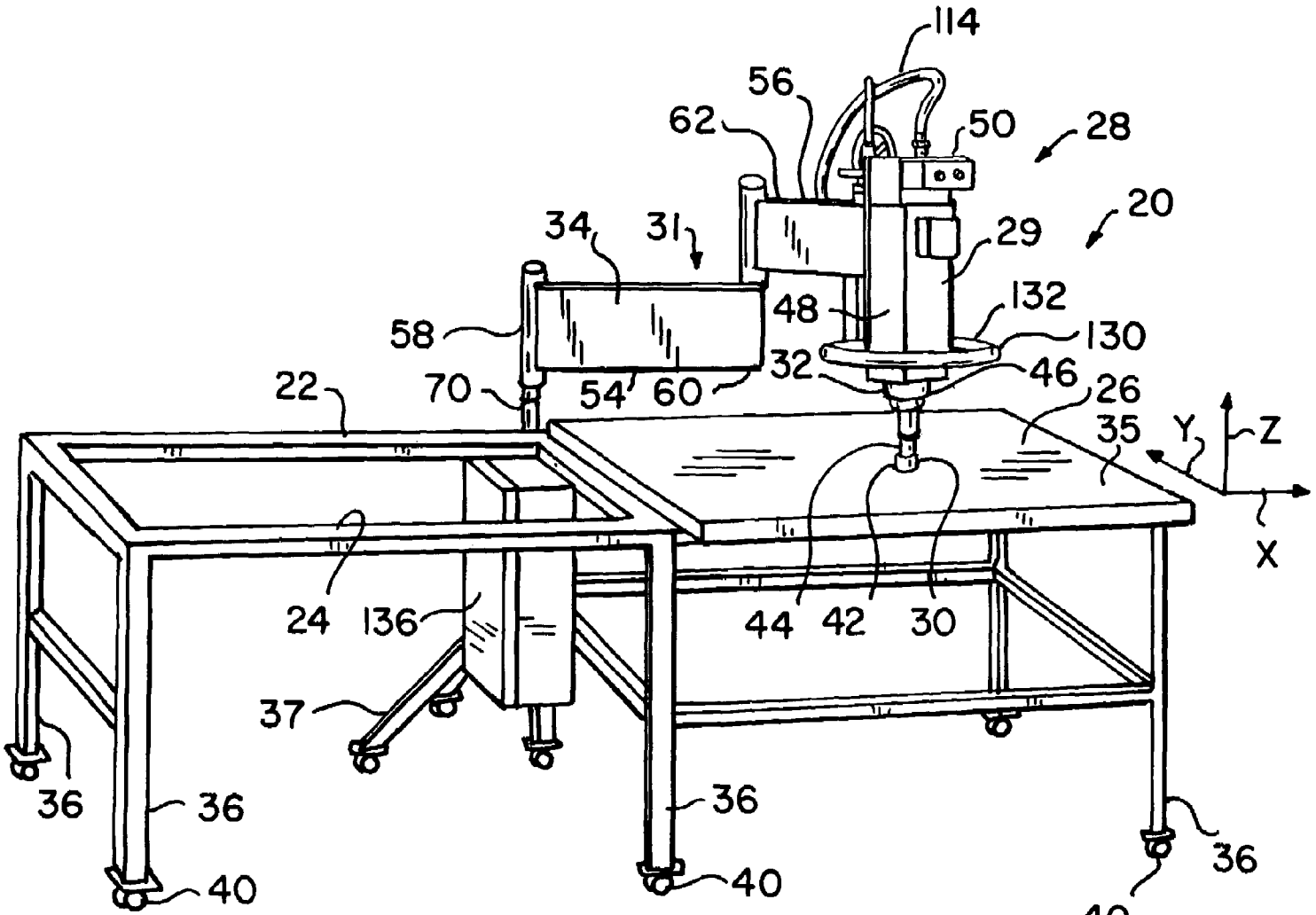
FIG. 1 is a perspective view of a stone cutting system within which features of the present invention are embodied.

Turning now to the drawings in greater detail and considering first FIG. 1, there is illustrated an embodiment, generally indicated 20, of a stone cutting system within which features of the present invention are embodied. The system 20 includes a frame 22 defining an upwardly-directed support surface 24 upon which a piece 26 of stone to be cut can be placed and means, generally indicated 28, for supporting a router-type cutting tool 30 for rotation about an axis of rotation while the tool 30 is moved in cutting engagement with the stone piece 26. The support means 28 includes a cutting head 29 having a motor 32 for rotating the tool 30 about its rotation axis and further includes joined means, generally indicated 31, joined between the motor 32 and the frame 22 in the form of an articulated arm assembly 34 enabling a user to manually move the cutting head 29 across the stone piece 26 while the tool 30 is maintained in cutting engagement with the stone piece 26.

Figure 2:
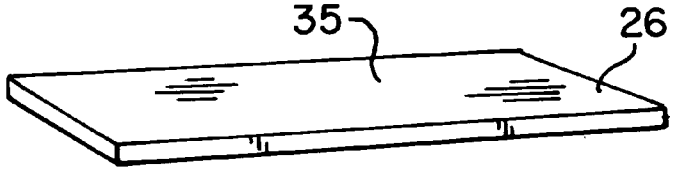
FIG. 2 is a perspective view of an example of a stone sheet which can be cut with the FIG. 1 cutting system.

As best shown in FIG. 2, the stone piece 26 to be cut with the depicted system 20 is substantially planar in shape and so that when positioned upon the frame 22 to be worked upon with the system 20, the plane of the stone piece 26 and more particularly, its planar upper surface, indicated 35, is oriented substantially horizontally and extends in two coordinate directions, hereinafter referred to as the X and Y coordinate directions and indicated as such in FIG. 1. The system 20 has been found to be suitable for cutting and shaping a stone piece for use as a kitchen countertop, and is therefore well-suited for cutting classes of stone, such as granite or marble, intended for this purpose. It will be understood that in accordance with the broader principles of this invention, the stone piece 26 can be comprised of a suitable stone material other than granite or marble.

Figure 3:
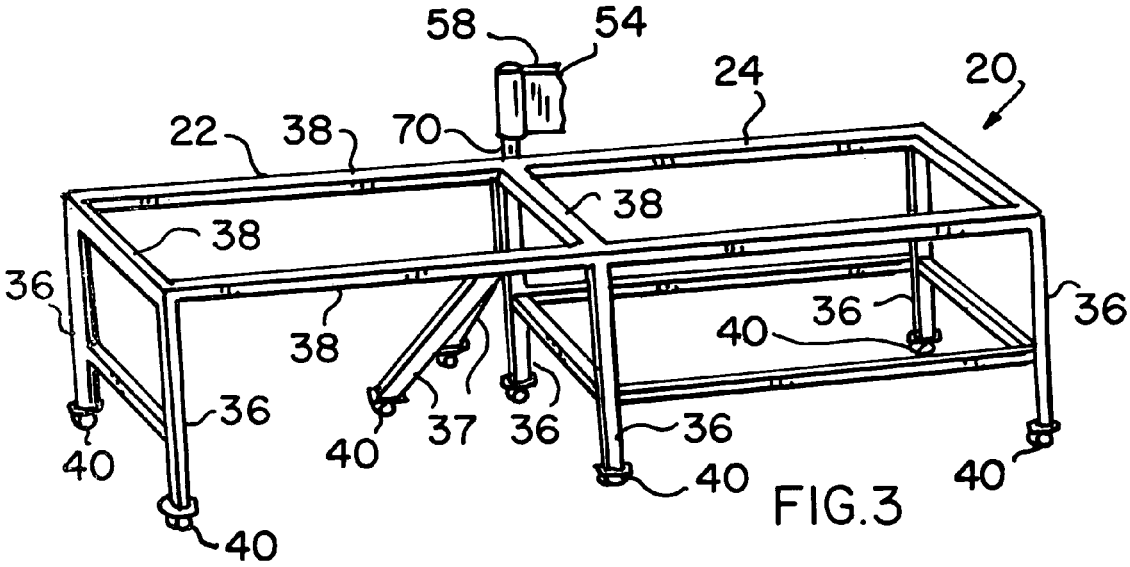
FIG. 3 is a perspective view of the frame of the FIG. 1 system.

With reference to FIG. 3, the frame 22 includes a plurality of (i.e. at least six) upstanding legs 36 and a plurality of linear members 38 which are joined atop the legs 36 to provide the upper support surface 24 for the frame 22. To enhance the stability of the frame 22 on the side thereof from which the cutting head 29 is supported, one of the legs 36 is braced with a pair of strut-like legs 37, as illustrated in FIG. 3. The support surface 24 is preferably long enough (e.g. between eight and twelve feet in length) to support a relatively lengthy stone piece 26 placed thereon to enable a stone piece of considerable length to be worked upon with the system 20. Each of the legs 36 and linear members 38 is comprised, for example, of steel and in the depicted frame 22 is comprised of steel channel having a square cross section. To enhance the capacity of the frame 22 to be moved (i.e. rolled) across a floor, each leg 36 or 37 is provided with a caster 40 at the lower end thereof.

By way of example, the support surface 24 of the frame 22 can be constructed to measure about eight feet long and about twenty-seven inches wide. Furthermore, the length of the legs 36 can be sized to provide the support surface 24 with a height of about thirty-eight inches, although the support surface 24 can be provided with an alternative height for conveniently working on a stone piece 26 positioned thereon.

If desired, the frame 22 can be overlain with an intermediate layer of materials, such as wooden boards 39 (FIG. 6), before the stone piece 26 is positioned upon the support surface 24. Such an intermediate layer of materials could provide the user with flexibility as to where he chooses to provide support directly beneath the stone piece 26.

With reference again to FIG. 1, the cutting tool 30 which is supported by the cutting head 29 for rotation is a router tool capable of cutting stone when the tool 30 is rotated about an axis and moved into cutting engagement with the stone piece 26. The tool 30 (which is of known construction) has a cutting body 42 having an outer peripheral surface and a terminal (end) surface which is covered with abrasive grit (including, for example, man-made diamonds) rendering the cutting tool 30 capable of being used as both a router and a drill. Thus, by rotating the tool 30 about its rotation axis and moving its terminal end into engagement with the planar surface 35 of the stone sheet 26, material of the stone sheet 26 is removed with the terminal end, and by subsequently moving the tool 30, when rotated, along X or Y coordinate directions, material of the stone sheet 26 is removed with the peripheral surface of the tool 30.

The cutting tool 30 also includes a shank portion 44 adapted to be accepted by and firmly secured within a standard tool holder 46 associated with the cutting head 29 so that when secured within the tool holder 46, the tool 32 depends downwardly therefrom and is thereby connected in driven relationship with the motor 32. Within the depicted system 20, the motor 32 is supported so that the axis of rotation of the cutting tool 30 is oriented along the vertical (i.e. the indicated Z-coordinate axis). Therefore and as will be apparent herein, by rotating the cutting tool 30 along the Z-coordinate axis and moving the cutting body 42 of the tool 30 along an X-Y coordinate path while in cutting engagement with the stone piece 26, the tool head 42 removes material from the stone piece 26 so that the width of the cut, or kerf, formed by the tool 30 corresponds with the width of the cutting body 42. A cutting tool which is suitable for use as the tool 30 are known as a radial arm finger bit and is available from VIC International, Inc. of Powell, Tenn.

Within the cutting head 29, the motor 32 is encased within a housing 48, and the housing 48 is, in turn, is supported by the articulated arm assembly 34 in a manner which permits the motor 32 and the tool 30 which depends downwardly therefrom to be moved to any X and Y coordinate location upon the upper surface 35 of the stone piece 26 and which permits the motor 32 and tool 30 to be moved along the Z-axis so that the tool 30 can be positioned at any of various depths within the stone piece 26 for removal of material therefrom. The motor 32 is electrically-powered and adapted to receive power from an electrical power source (not shown) and can be turned ON and OFF with a switch 50. An example of a motor suitable for use as the motor 32 is a three-phase, 415/240 volt motor capable of rotating at about 10,000 rpm and is available from Venetia Elettro Maccanica of Italy. If such an exemplary motor is used as the motor 32 and a user of the system 20 only has access to a single-phase, 220 volt power supply, then an inverter, indicated 136 in FIG. 1, capable of converting single phase (e.g. 220 volt) power input to three-phase, variable-frequency power output may need to be employed.

Figure 4:
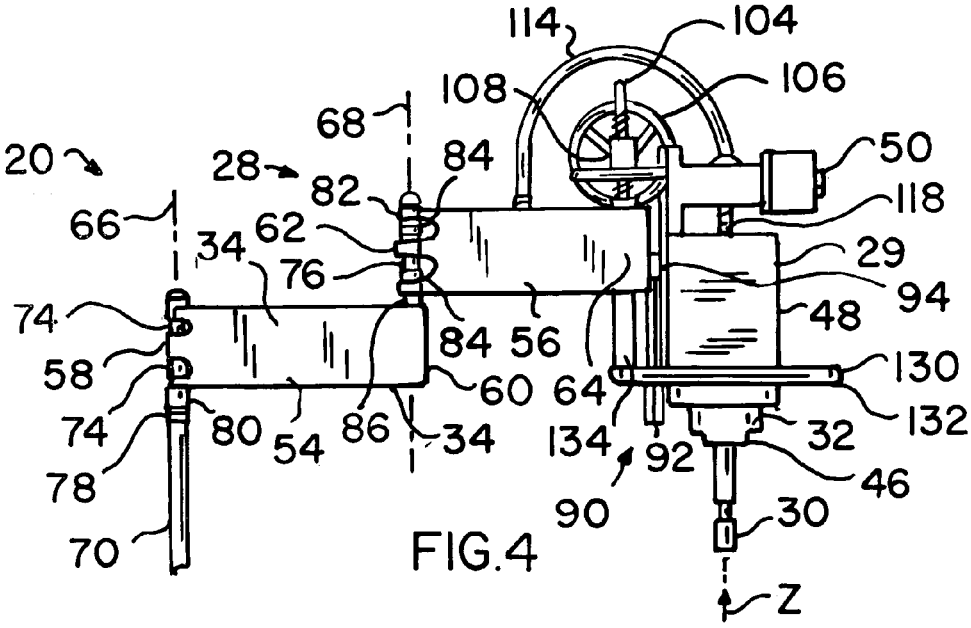
FIG. 4 is a fragmentary side view of the cutting head and articulated arm assembly, shown partially cut-away, of the FIG. 1 system used for supporting the cutting head above the frame.

Within the depicted system 20 and with reference to FIG. 4, the articulated arm assembly 34 includes a pair of articulated, or linked, arm members 54, 56 which are joined to one another above the support surface 24 of the frame 22 and which are interposed between the cutting head 29 and the frame 22 enabling the cutting head 29 and the tool 30 supported thereby to be moved to any X and Y coordinate position across the upper surface 35 (FIG. 1) of the stone piece 26. Each arm member 54 or 56 is elongated in shape, possesses a substantially rectangular cross section along a major portion of its length, and is arranged so that its longitudinal axis is oriented substantially horizontally.

One of, or a first, arm member 54 has two opposite ends 58, 60, while the other, or second, arm member 56 has two opposite ends 62, 64. The end 58 of the first arm member 54 is pivotally joined to the frame 22 to permit pivotal movement of the first arm member 58 relative to the frame 22 about a first (and vertical) axis of pivot, indicated 66. Meanwhile, the ends 60 and 62 of the first and second arm members 54 and 56 are pivotally joined together to accommodate pivotal movement of the arm members 54 and 56 relative to one another about a second (and vertical) axis of pivot, indicated 68. The end 68 of the second arm member 56 is attached, in a manner described herein, to the cutting head 29 so that the cutting head 29 is supported in a cantilevered fashion by the arm assembly 34 above the support frame 22.

For purposes of joining the assembly 34 of arm members 54, 56 to the frame 22 and for supporting the arm assembly 34 above the support surface 24 of the frame 22, the frame 22 includes a vertically-oriented support post 70 which is arranged adjacent the leg 36 (FIG. 3) of the frame 22 to which the strut-like legs 37 are secured and is attached thereto so that the post 70 is secured in a fixed and stationary relationship with respect to the remainder of the frame 22.

For securement of the first arm member 54 (FIGS. 3 and 4) to the post 70, the first arm member 54 includes an outer sleeve portion 80 at the end 58 thereof and which is positioned about the post 70, and there is provided a pair of spaced-apart wheel (e.g. ball) bearings 74 which are interposed between the inner surface of the outer sleeve portion 80 and the outer surface of the post 70 to accommodate the pivotal movement of the first arm member 54 relative to the frame 22 about the first vertically-disposed axis 66. A collar 78 can be secured about the post 70 directly beneath the outer sleeve portion 80 for supporting the weight of the arm assembly 34. At the other end 60 of the first arm member 54 there is joined a post portion 76 which extends vertically from the end 60, and this post portion 76 is used to join the second arm member 56 to the first arm member 56.

In this connection, the second arm member 56 includes an outer sleeve portion 82 at the end 62 thereof and which is positioned about the post portion 76, and there is provided a pair of spaced-apart wheel (e.g. ball) bearings 84 which are interposed between the inner surface of the outer sleeve portion 82 and the outer surface of the post portion 76 to accommodate the pivotal movement of the second arm member 56 relative to the first arm member 54 about the second vertically-disposed axis 68. If desired, a collar 86 can be positioned about the post portion 76 and directly beneath the outer sleeve portion 82 for supporting the weight of the second arm member 56.

It follows that by pivotally moving the second arm member 56 relative to the first arm member 54 about the second vertical axis 68 and by moving the second arm member 56 relative to the frame 22 about the vertical axis 66, the end 64 of the second arm member 56 can be positioned over any X-Y coordinate position across the support surface 24 of the frame 22 and therefore, over any X-Y coordinate position across the upper surface 35 of a stone piece 26 positioned upon the support surface 24 of the frame 22. It also follows that the cutting head 29 (and the cutting tool 30 supported thereby) which is connected to the end 64 of the second arm member 56 can be positioned above any X-Y coordinate position across the upper surface 35 of a stone piece 26 positioned upon the frame support surface 24.

It is a feature of the system 20 that the bearings in each set of bearings 74 and 84 are spaced apart (by, for example about 9.0 to 11.0 inches) along the corresponding post 70 or post portion 76 about which the bearings are positioned. Such a spacing is believed to provide sufficient strength to resist appreciable deformation or bending of the arm assembly 34 as the result of upwardly or downwardly-directed forces which may be applied at the cutting head 29. This advantage can be appreciated when considering the appreciable weight of the cutting head 29 which is expected to be supported by the arm assembly 34 between cutting operations.

Figure 5:
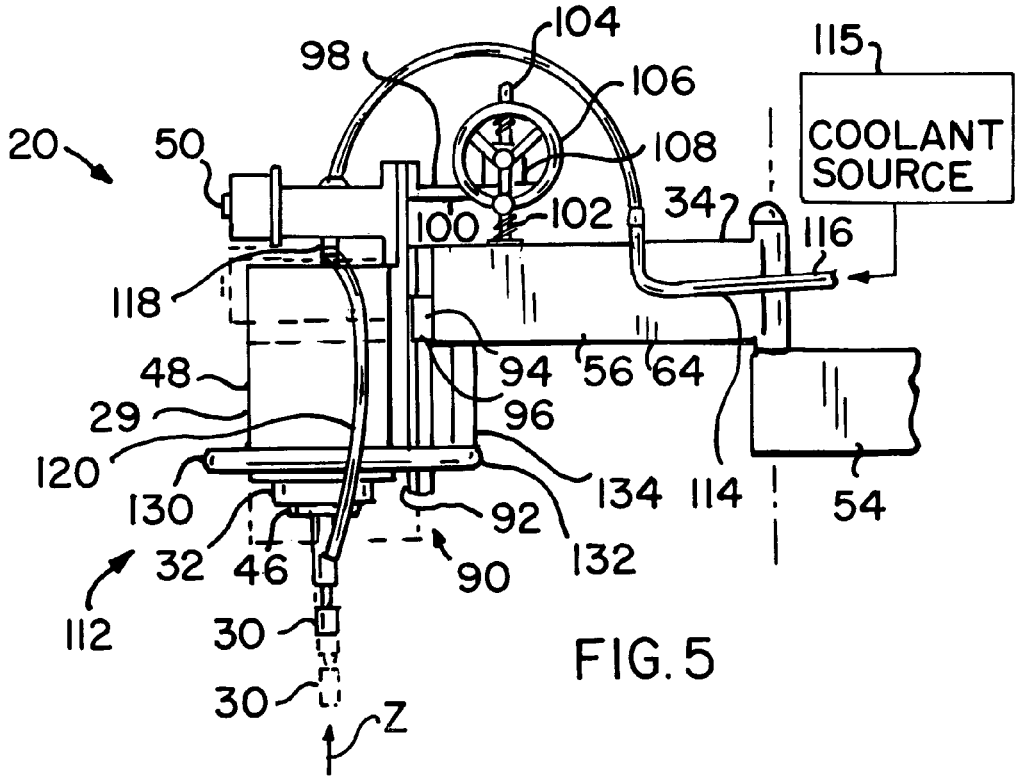
FIG. 5 is a alternative and fragmentary side view of the cutting head of the FIG. 1 system.

To enable the cutting head 29 and the tool 30 to be moved along the indicated Z-coordinate axis (and thus toward and away from the upper surface 35 of the stone piece 26 and with reference to FIGS. 4 and 5), a linear bearing assembly 90 is interposed between the motor housing 48 and the end 64 of the second arm member 56. In the depicted embodiment, the linear bearing assembly 90 includes a vertically-disposed guide track member 92 having a pair of opposite linear side edges and which is fixedly secured to the cutting head 29 so that the linear side edges of the guide track member 92 are arranged along vertical paths. The bearing assembly 90 further includes means providing a guide track follower 94 which cooperates with the side edges of the guide track member 92 so that permitted movement of the guide track follower 94 along the guide track member 92 is confined to linear movement along a vertical path. In the depicted assembly 90, the guide track follower 94 includes a pair of flanges 96 (only one illustrated in FIG. 5) which are positioned about the side edges of the guide track member 92 to prevent any rotation or shifting of the cutting head 29 relative to the second arm member 56 about the Z-coordinate axis and so that as the guide track member 92 is moved linearly along the guide track follower 94, the movement of the cutting head 29, and the cutting tool 30 supported thereby, is confined along a vertical path or, more specifically, along the indicated Z-coordinate axis.

For purposes of moving the cutting head 29 and cutting tool 30 upwardly and downwardly along the guide track member 92, there is fixedly joined to the cutting head 29 a bracket 98 having a flange 100 which is positioned above the end 64 of the second arm member 56, and a jackscrew assembly 102 is interposed between the arm member 56 and the flange 100 enabling the flange 100 and arm member 56 to be moved toward or away from one another by a user. The jackscrew assembly 102 includes a vertically-arranged threaded rod 104 which is journaled at its lower end to the upper surface of the arm member 56 and extends upwardly from the arm member 56 through the bracket flange 100. A rotatable crank 106 is journaled to the flange 100 for rotation about a horizontal rotation axis and is connected, through a suitable gear assembly 108, to the threads provided along the rod 104 so that by rotating the crank 106 in one rotational direction or another about its rotation axis, the rod 104 is moved upwardly or downwardly relative to the arm member end 64 so that the bracket flange 100, and hence the cutting head 29 and cutting tool 30, are moved upwardly and downwardly relative to the frame 22 between, for example, the position illustrated in solid lines in FIG. 5 and the position illustrated in phantom in FIG. 5.

It follows that if a user of the system 20 desires to raise or lower the cutting tool 30 relative to a stone piece 26 positioned upon the frame support surface 24 and thereby adjust the depth-of-cut of the cutting tool 30 in the stone piece 26, the user rotates the crank 106 in an appropriate rotational direction about its rotation axis. More specifically, the rotation of the crank 106 in one rotational direction about its rotation axis effects a lowering of the cutting tool 30 relative to the support surface 24 of the frame 22 by a corresponding amount while the rotation of the crank 106 in the opposite rotational direction about its rotation axis effects a raising of the cutting tool 30 relative to the frame support surface 24 by a corresponding amount. Within the depicted system 20, one rotation of the crank 106 effects a corresponding movement of the cutting tool 30 along the Z-axis by about 1/20th of an inch (i.e. about 0.05 inches in depth).

With reference again to FIGS. 1, 4 and 5, the system 20 also includes a hand grip 130 with which the cutting head 29 and the cutting tool 30 supported thereby can be manually guided by a user along the X and Y coordinate directions. Within the depicted system 20, the hand grip 130 includes a ring 132 which encircles the cutting head 29 adjacent the lower end thereof, and the ring 132 is joined to the remainder of the cutting head 29 by way of a support post 134 which extends between the ring 132 and the underside of the second arm member 56. By grasping the hand grip 134 (with one or both hands), the user can manually guide the cutting head 29 and the tool 30 supported thereby to any of a number of X and Y locations across the surface 35 of the stone piece 26 as the arm members 54 and 56 pivot about the pivot axes 66 and 68, as necessary.

The system 20 also includes means, generally indicated 112 in FIG. 5, for cooling the motor 32 and the cutting tool 30 during a stone-cutting operation performed with the system 20. Within the system 20, the cooling means 112 includes a network 114 of conduits including a conduit 116 having an end which is capable of being hooked up to a source, indicated 115 in FIG. 5, of liquid coolant (e.g. water) and another end which terminates at a Tee-connector 118. One branch of the Tee-connector 118 is connected in flow communication with the motor 32 at the upper end thereof for directing the liquid coolant downwardly along the shaft of the motor 32 and another branch of the Tee-connector 118 is connected to another conduit 120 which extends downwardly from the Tee-connector 118 and along one side of the motor housing 48 for delivering the liquid coolant directly onto the cutting tool 30. During operation of the system 20 during which the motor 32 rotates the cutting tool 30 at a relatively high rate of speed, liquid coolant is permitted to flow by way of the conduit network 114 downwardly along the motor shaft for purposes of cooling the motor 32 and onto the cutting tool 30 for purposes of cooling the tool 30.

Figure 6:
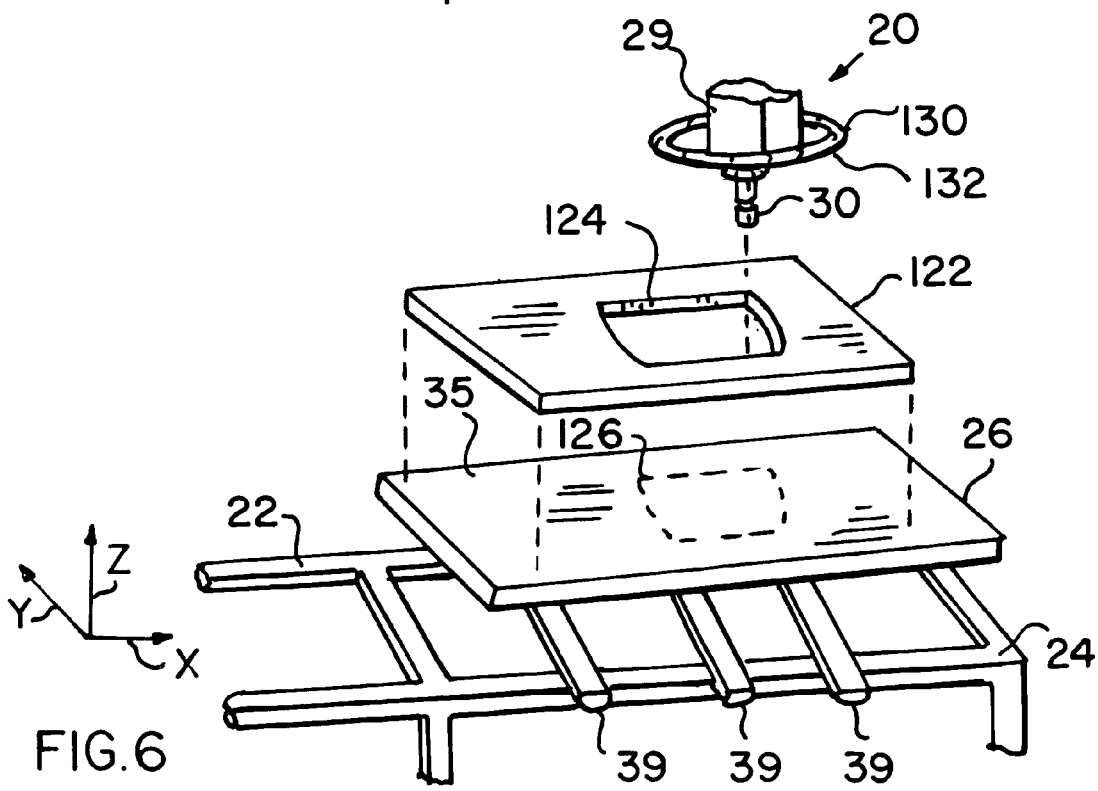
FIG. 6 is a fragmentary perspective view, shown exploded, illustrating the use of the FIG. 1 system for cutting or forming a cuttout in a stone sheet.

To use the system 20 to form a cutout in a piece 26 of stone sheet and with reference to FIG. 6, the stone piece 26 is placed upon the support surface 24 of the frame 22. As mentioned earlier, a layer of wooden boards 39 can be initially positioned across the support surface 24 of the frame 22 so that a stone piece 26 subsequently positioned across the boards 39 sandwiches the boards 39 between the frame support surface 24 and the stone piece 26. A template 122 can then be placed over the upper surface 35 of the stone piece 26 for guiding the cutting tool 30 along a desired path, such as the dotted-line path 126 in FIG. 6, as the tool 32 is moved over the stone piece 26.

The template 122 can be a planar sheet having a preformed hole 124 cut therein whose dimensions correspond with those of the cutout (e.g. that traced by the path 126) desired to be formed in the stone piece 26. The material of the template 122 can be comprised, for example, of a high density plastic material which is not easily cut by the cutting tool 30 when, and if, the rotating tool 30 comes into contact with the material of the template 122. Consequently, the cutting tool 30 can be positioned within the preformed hole 124 and manually guided along the inside edges of the hole 124 while contacting the stone piece 26 so that material of the stone piece 26 is removed by the cutting tool 30. Therefore and by guiding the cutting tool 30 along the entire edge of the preformed hole 124, the stone piece 26 is cut along its desired path.

With the template 122 in position over the stone sheet 26, the cutting tool 30 is positioned above a desired X-Y coordinate location along the path of the desired cut (e.g. that traced by the path 126), and the motor 32 is switched ON so that the cutting tool 30 begins to rotate about the Z-axis. The cutting tool 30 is then lowered (by way of the crank 106 and associated jackscrew assembly 102) until the lower end of the cutting tool 30 engages and cuts into the stone sheet 26.

The cutting tool 30 is not lowered very deeply (e.g. only by about 1/20th of an inch) into the material of the stone sheet 26 before the tool 30 is moved (i.e. guided) along the desired cutting path (i.e. along the inside edge of the preformed hole 124 of the template 122) as the user's hands are gripped about the ring 132 of the grip 130. As the tool 30 is moved along the desired cutting path, material is removed from the stone sheet 26 to effect a cut therein. Upon completion of one pass of the cutting tool 30 along the desired cutting path (e.g. that traced by the path 126), the tool is again lowered by a small amount (e.g. about 1/20th of an inch) and then the cutting tool 30 is again passed along the length of the cutting path. The steps of passing the tool 30 along the entire length of the cutting path and then lowering the tool 30 by a small amount are repeated until the area of material bordered by the desired path (e.g. the path 126) is completely severed from the remainder of the stone sheet 26.

It follows that a system and method have been described for cutting a stone sheet wherein the system 20 is comprised of a relatively few number of component parts and can be used relatively easily. Furthermore, the articulated arm assembly 34 of the system 20 enables a user to readily position the cutting tool 30 at a desired X-Y coordinate location across the planar surface 35 of the stone sheet 26 for working upon the stone piece 26 at that desired X and Y coordinate location. Once positioned at the desired X and Y coordinate location across the stone piece 26, the tool 30 is lowered into engagement with the stone sheet 26 for subsequent movement of the cutting tool 26 along a desired cutting path while the cutting tool 30 remains in cutting engagement with the stone sheet 26. By removing material from the stone sheet 26 with the cutting tool 30, the cutting tool 30 cuts the stone sheet 26.

It will be understood that numerous modifications and substitutions can be had to the aforedescribed embodiment 20 without departing from the spirit of the invention. For example, although the cooling means 112 of the depicted system 20 has been shown and described as including a single conduit 120 for delivering coolant to one side of the cutting tool 30 during a cutting operation, a cooling means in accordance with the broader aspects of the present invention can include a pair of conduits for delivering coolant to the opposite sides of the cutting tool 30 so that during a cutting operation, coolant is delivered to opposite sides of the cutting tool for purposes of cooling both the tool 30 and the site on the stone at which the stone is being cut by the tool 30. Accordingly, the aforedescribed embodiment is intended for the purpose of illustration and not as limitation.

The invention claimed is:

1. A stone cutting system for cutting a stone sheet having a substantially planar surface, the system comprising:

a frame upon which a stone sheet to be cut can be positioned so that when the stone sheet is placed upon the frame, the substantially planar surface of the stone sheet extends along X and Y coordinate axes;

means for supporting a cutting tool adjacent the frame for rotation about a Z-coordinate axis and for rotating the cutting tool about the Z-coordinate axis;

means joined between the frame and the tool-supporting means for supporting the tool-supporting means for movement relative to the frame along either of the X and Y coordinate directions to enable a cutting tool which is supported by the tool-supporting means to be positioned at any of a number of X and Y coordinate locations across the substantially planar surface of a stone sheet positioned upon the frame; and means associated with the tool-supporting means for moving a cutting tool which is supported by the tool-supporting means along the Z-coordinate axis toward and into engagement with the substantially planar surface of a stone sheet positioned upon the frame so that by rotating the cutting tool about the Z-coordinate axis while the cutting tool is moved in cutting engagement with the stone sheet along X or Y coordinate directions, material is removed from the stone sheet by the cutting tool.

2. The system as defined in claim 1 wherein the tool-supporting means includes an electric motor and means for releasably attaching a cutting tool in driven relationship with the electric motor so that when operated, the electric motor rotates the cutting tool about the Z-coordinate axis.

3. The system as defined in claim 1 wherein the joined means includes an articulated arm assembly having arm members which are pivotally joined to one another in a manner which facilitates the positioning of a cutting tool which is supported by the tool-supporting means at any of a number of X and Y coordinate locations across the substantially planar surface of a stone sheet positioned upon the frame.

4. The system as defined in claim 3 wherein the articulated arm assembly includes a first elongated arm member and a second elongated arm member, a first end of the first arm member being pivotally joined to the frame for pivotal movement of the first arm member relative to the frame about the Z-coordinate axis and one end of the second arm member being pivotally joined to a second end of the first arm member opposite said first end for pivotal movement of the second arm member relative to the first arm member about the Z-coordinate axis, and the tool-supporting means is attached to an end of the second arm member opposite said one end.

5. The system as defined in claim 4 wherein the first arm member is pivotally joined to the frame with a first bearing assembly, and the second arm member is pivotally joined to the first arm member with a second bearing assembly.

6. The system as defined in claim 5 wherein each of the first and second bearing assemblies includes a pair of bearings, and the bearings of each pair is spaced apart by a distance of about ten to twelve inches.

7. The system as defined in claim 1 further comprising a hand grip adapted to grasped by the hands of a user of the system and which is secured to the tool-supporting means enabling a cutting tool which is supported by the tool-supporting means to be manually guided along X and Y coordinate directions across the substantially planar surface of a stone sheet positioned upon the frame while the hands of the user remain grasped about the hand grip.

8. The system as defined in claim 1 further comprising means for cooling a cutting tool which is supported by the tool-supporting means while the cutting tool performs a cutting operation upon a stone sheet positioned upon the frame.

9. The system as defined in claim 1 wherein the frame defines an upwardly-directed support surface upon which the stone sheet to be cut can be positioned, and the tool-supporting means is arranged above the support surface of the frame so that when a stone sheet is positioned upon the frame support surface to be worked upon by a cutting tool supported by the tool-supporting means, the stone sheet is disposed between the frame support surface and the tool-supporting means.

10. The system as defined in claim 1 wherein the associated means includes a manually-operable jackscrew assembly having a crank mounted for rotation relative to the frame so that by rotating the crank in one rotational direction effects a movement of a cutting tool supported by the tool-supporting means toward a stone piece positioned upon the frame.

11. A system for cutting a stone sheet having a substantially planar surface, the system comprising:

a frame defining an upwardly-directed support surface upon which a stone sheet to be cut can be positioned for cutting purposes and so that the substantially planar surface of the stone sheet faces upwardly and extends in X and Y coordinate directions;

a rotatable cutting tool;

means attached to the cutting tool for supporting the cutting tool for rotation along the Z-coordinate axis and means for rotating the cutting tool about the Z-coordinate axis;

means joined between the tool-supporting means and the frame for supporting the tool-supporting means in a superposed condition above the frame support surface and for movement of the cutting tool relative to the frame along X and Y coordinate directions to accommodate the positioning of the cutting tool at any of a number of X and Y coordinate locations across the substantially planar surface of a stone sheet positioned upon the frame support surface; and means associated with the tool-supporting means for moving the cutting tool relative along the Z-coordinate axis and toward and away from the stone sheet to be cut so that by rotating the cutting tool about the Z-coordinate axis and moving the cutting tool along X and Y coordinate directions while the cutting tool is maintained in cutting engagement with the stone sheet, the cutting tool effects a cut in the stone sheet.

12. The system as defined in claim 11 wherein the joined means includes an articulated arm assembly having arm members which are pivotally joined to one another in a manner which facilitates the positioning of the cutting tool at any of a number of X and Y coordinate locations across the substantially planar surface of a stone sheet positioned upon the frame support surface.

13. The system as defined in claim 12 wherein the articulated arm assembly includes a first elongated arm member and a second elongated arm member, a first end of the first arm member being pivotally joined to the frame for pivotal movement of the first arm member relative to the frame about the Z-coordinate axis and one end of the second arm member being pivotally joined to a second end of the first arm member opposite said first end for pivotal movement of the second arm member relative to the first arm member about the Z-coordinate axis, the tool-supporting means is attached to an end of the second arm member opposite said one end, and the articulated arm assembly possesses sufficient strength to resist deformation when appreciable forces are exerted upon the tool-supporting means along the Z-coordinate axis.

14. The system as defined in claim 13 wherein the first arm member is pivotally joined to the frame with a first bearing assembly and the second arm member is pivotally joined to the first arm member with a second bearing assembly.

15. The system as defined in claim 11 further comprising a hand grip adapted to grasped by the hands of a user of the system and which is secured to the tool-supporting means enabling the cutting tool to be manually guided along X and Y coordinate directions across the substantially planar surface of a stone sheet positioned upon the frame support surface while the hands of the user remain grasped about the hand grip.

16. The system as defined in claim 11 further comprising means for directing a liquid coolant to the cutting tool for cooling the cutting tool during a stone-cutting operation performed with the cutting tool.

* * * * *

UNITED STATES PATENT AND TRADEMARK OFFICE

CERTIFICATE OF CORRECTION

PATENT NO. : 7,229,342 B1
APPLICATION NO. : 11/644425
DATED : June 12, 2007
INVENTOR(S) : Rodney L. York It is certified that error appears in the above-identified patent and that said Letters Patent is hereby corrected as shown below:

Column 4, line 7, delete “are” and substitute --is-- therefor.

Column 9, line 32 and column 10, line 53, before “grasped”, insert --be--.

Column 9, line 56, delete “by”.

Column 10, line 3, delete “along” and substitute --about-- therefor.

Column 10, line 17, delete “relative”.

Signed and Sealed this

Nineteenth Day of February, 2008

JON W. DUDAS
*Director of the United States Patent and Trademark Office*